US010141663B1

(12) United States Patent
Tsau

(10) Patent No.: US 10,141,663 B1
(45) Date of Patent: Nov. 27, 2018

(54) COAXIAL CABLE CONNECTOR

(71) Applicant: EZCONN CORPORATION, Taipei (TW)

(72) Inventor: Chang-Jie Tsau, Taipei (TW)

(73) Assignee: EZconn Corporation, Taipei (TW)

( * ) Notice: Subject to any disclaimer, the term of this patent is extended or adjusted under 35 U.S.C. 154(b) by 0 days.

(21) Appl. No.: 15/973,484

(22) Filed: May 7, 2018

(30) Foreign Application Priority Data

May 8, 2017 (TW) ..... 106206482 U

(51) Int. Cl.
*H01R 9/05* (2006.01)
*H01R 13/41* (2006.01)
*H01R 13/506* (2006.01)

(52) U.S. Cl.
CPC ..... *H01R 9/05* (2013.01); *H01R 13/41* (2013.01); *H01R 13/506* (2013.01)

(58) Field of Classification Search
CPC ..... H01R 9/05; H01R 13/41; H01R 13/506; H01R 9/0503; H01R 9/0521
USPC ..... 439/578, 583
See application file for complete search history.

(56) References Cited

U.S. PATENT DOCUMENTS 2,181,860 A * 12/1939 Adkinson ..... H04B 15/025 174/397
2,258,737 A * 10/1941 Browne ..... H01R 24/40 174/75 C
2,296,766 A * 9/1942 Bruno ..... H01R 24/566 174/22 C
8,926,362 B2 * 1/2015 Xu ..... H01R 13/62 439/583
9,762,008 B2 * 9/2017 Burris ..... H01R 9/05

* cited by examiner

*Primary Examiner* — Khiem Nguyen

(57) ABSTRACT

A coaxial cable connector comprising a connector body, a dielectric component, and a conductor component is provided. The connector body has a threaded outer surface, a radially protruding head portion, and an altered hex-shaped end portion. The altered hex-shaped end portion and radially protruding head portion surround the first body opening end of the connector body. The connector body further comprises a through-hole having a radially inner protruding end portion on an inner surface of the first connector body end. The dielectric component has a cylindrical center tube, a radially protruding head end portion, and a plurality of flexible snap hooks. The plurality of flexible snap hooks slide along guide passageways of the radially inner protruding end portion of the through-hole, fittably hooking and locking against an annular inner lock back wall thereof. The first conductor component extends through the cylindrical center tube of the dielectric component.

20 Claims, 4 Drawing Sheets

COAXIAL CABLE CONNECTOR

RELATED APPLICATIONS

The present application claims priority to Taiwan application no. 106206482, filed on May 8, 2017, of which is hereby incorporated by reference in its entirety.

BACKGROUND OF THE INVENTION

Field of the Invention

The invention relates to connectors, and more particularly, to coaxial cable connectors.

Description of the Related Art

Coaxial cables continue to be used using connectors such as twistable F-type coaxial cable connectors. The F-type connectors are used for connection with cable TV decoders, digital video recorders and DVD recorders, satellite receivers and distribution amplifiers or signal splitters, etc., having a connection means built therein.

Conventional assembled connectors comprise an inner conductor surrounded by an insulating layer, surrounded by a housing. The insulating layer insulates the inner conductor from the housing and positions the inner conductor within the housing.

However, assembly of the conventional connectors is troublesome.

There is demand for coaxial cable connectors to solve the aforementioned problem.

BRIEF SUMMARY OF THE INVENTION

Coaxial cable connectors are provided.

In an embodiment, the coaxial cable connector comprises a connector body, a first dielectric component, and a first conductor component. The connector body has a threaded outer surface, a radially protruding head portion, an altered hex-shaped end portion, and a through-hole therethrough having a central axis comprising a first body opening end and a second body opening end opposite the first body opening end. The altered hex-shaped end portion and radially protruding head portion surround the first body opening end of the connector body. The through-hole has a radially inner protruding end portion disposed on an inner surface of the first connector body end, wherein the radially inner protruding end portion has an annular inner lock back wall facing the second body opening end and a plurality of guide protrusions laterally disposed thereon. The plurality of guide protrusions each has an inner guide front wall facing the first body opening end and are separated by two opposite side walls perpendicular to the inner guide front wall, forming a plurality of guide passageways between each of the plurality of guide protrusions.

In an embodiment, the first dielectric component has a cylindrical center tube, a radially protruding head end portion surrounding a front end of the cylindrical center tube, and a plurality of flexible snap hooks flaring backwards from a backside of the radially protruding head end portion along the outside of the cylindrical center tube having a plurality of backside spaces therebetween. The plurality of flexible snap hooks fittably sit within the a plurality of guide passageways of the radially inner protruding end portion and between the plurality of guide protrusions, fittably hooking and locking against the annular inner lock back wall of the radially inner protruding end portion. The plurality of backside spaces of the first dielectric component fittably rest upon each of the inner guide front walls of the connector body. The central axis of the connector body and first dielectric component are the same. The first dielectric component is engaged and fixed within the first body opening end of the connector body.

In an embodiment, the first conductor component, comprises a center conductor having a conductor front end and conductor back end, and an outer flange surrounding the conductor back end, wherein the conductor front end extends through the cylindrical center tube, protruding to an outside of the radially protruding head end portion surrounding the front end thereof and connector body. The outer flange fittably rests upon on a back end of the cylindrical center tube. The first conductor component can be electrically connected to a coaxial cable having an electrical wire, sending electrical signals. In an embodiment, the first conductor component comprises a solid metal wire.

In an embodiment, the coaxial cable connector further comprises a second dielectric component and a second conductor component. The second conductor component has a tapered front end and a back section. The second conductor component further comprises a plurality of flexible positioning guides assembled to the back section thereof, each having a free front end and an attached back end. The free front end extends downward and inward toward a center of a second conductor through-hole. The central axis of the second conductor component and connector body is the same. The second dielectric component has a second dielectric tube body having a second dielectric through-hole. The second dielectric through-hole has a second dielectric front opening and a second dielectric back opening. In an embodiment, the tapered front end of the second conductor component fittably surrounds the conductor back end of the first conductor component to rest upon the outer flange thereof, opposite the back end of the cylindrical center tube of the first dielectric component. The second dielectric front opening fittably surrounds the back section of the second conductor component. The second dielectric component and the second conductor component are disposed in the through-hole of the connector body. The first conductor component is electrically connected to the second conductor component, sending electrical signals from a coaxial cable having an electrical wire.

In an embodiment, the coaxial cable connector further comprises an inner sleeve fittably assembled within the second body opening end of the connector body and fittably surrounding the second dielectric back opening of the second dielectric component.

In an embodiment, the cylindrical center tube, radially protruding head end portion and plurality of flexible snap hooks of the first dielectric component are integrally formed. In an embodiment, the threaded outer surface, inner connector body surface portion, radially inner protruding end portion and plurality of guide protrusions of the connector body are integrally formed.

These, as well as other components, steps, features, benefits, and advantages of the present application, will now made clear by reference to the following detailed description of the embodiments, the accompanying drawings, and the claims.

BRIEF DESCRIPTION OF THE DRAWINGS

The accompanying drawings, which are incorporated herein and form a part of the Detailed Description of the Invention, illustrate various embodiments of the present invention and, together with the Detailed Description of the Invention, serve to explain principles discussed below. The drawings referred to in this Brief Description of Drawings should not be understood as being drawn to scale unless specifically noted.

DETAILED DESCRIPTION OF THE INVENTION

Figure 1:
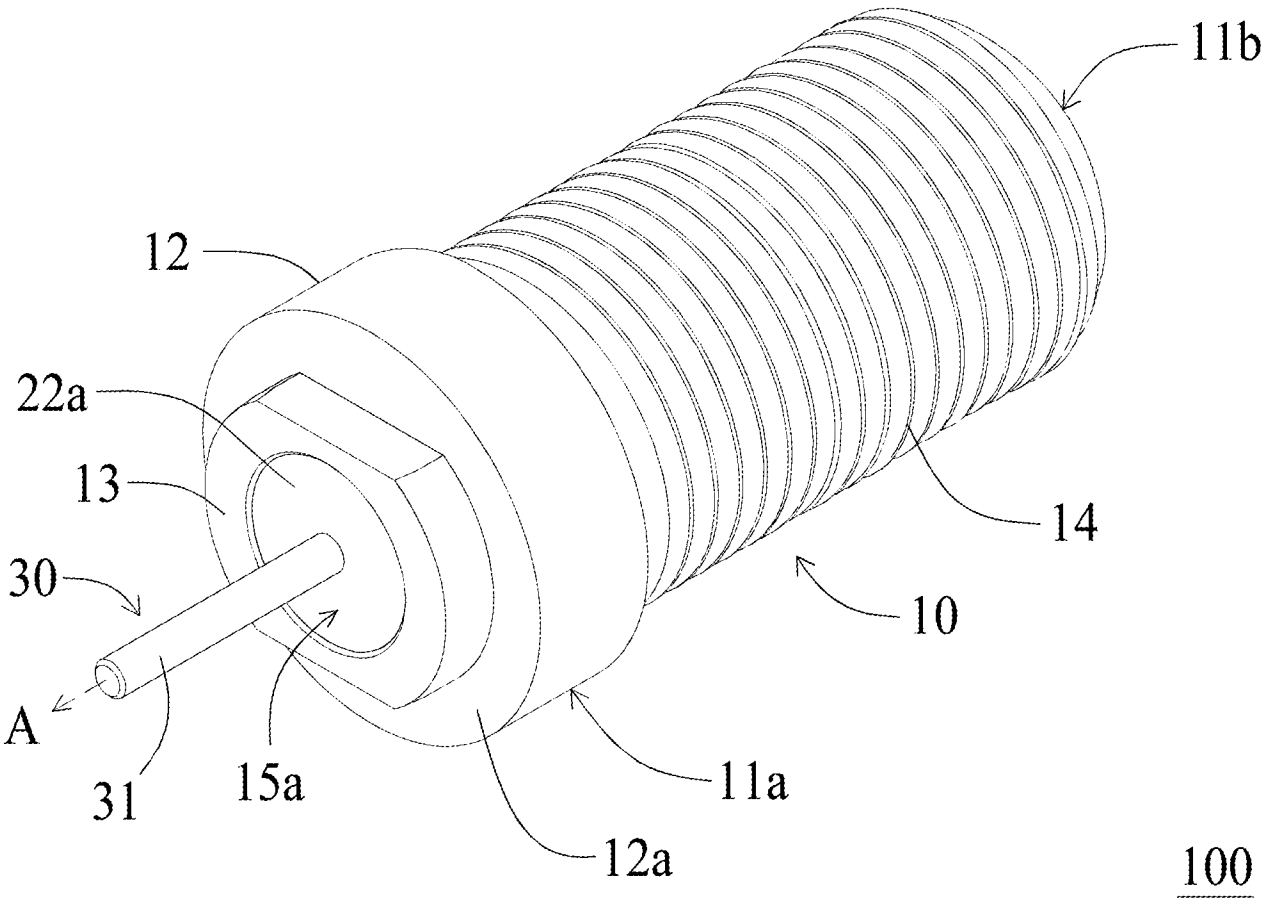
FIG. 1 is a perspective view illustrating a coaxial cable connector according to various embodiments.

It is understood that the following disclosure provides many different embodiments, or examples, for implementing different features of the invention. Specific examples of devices and arrangements are described below to simplify the present disclosure. These are, of course, merely examples and are not intended to be limiting. For example, the formation of a first feature over or on a second feature in the description that follows can include embodiments in which the first and second features are formed in direct contact, and can also include embodiments in which additional features are formed between the first and second features, such that the first and second features are not in direct contact. In addition, the present disclosure can repeat reference numerals and/or letters in the various examples. This repetition is for the purpose of simplicity and clarity and does not in itself dictate a relationship between the various embodiments and/or configurations discussed. It is intended that the scope of the present technology be defined by the claims appended hereto and their equivalents.

FIG. 1 is a perspective view illustrating a coaxial cable connector according to various embodiments. In the embodiments, as an example, but not to be limiting, a coaxial cable connector can be a twist-type connector for connection to cable TV decoders, digital video recorders and DVD recorders, satellite receivers and distribution amplifiers or signal splitters, etc., having a connection means built therein and an electromagnetic interference (EMI) shielded enclosure or housing.

Figure 2:
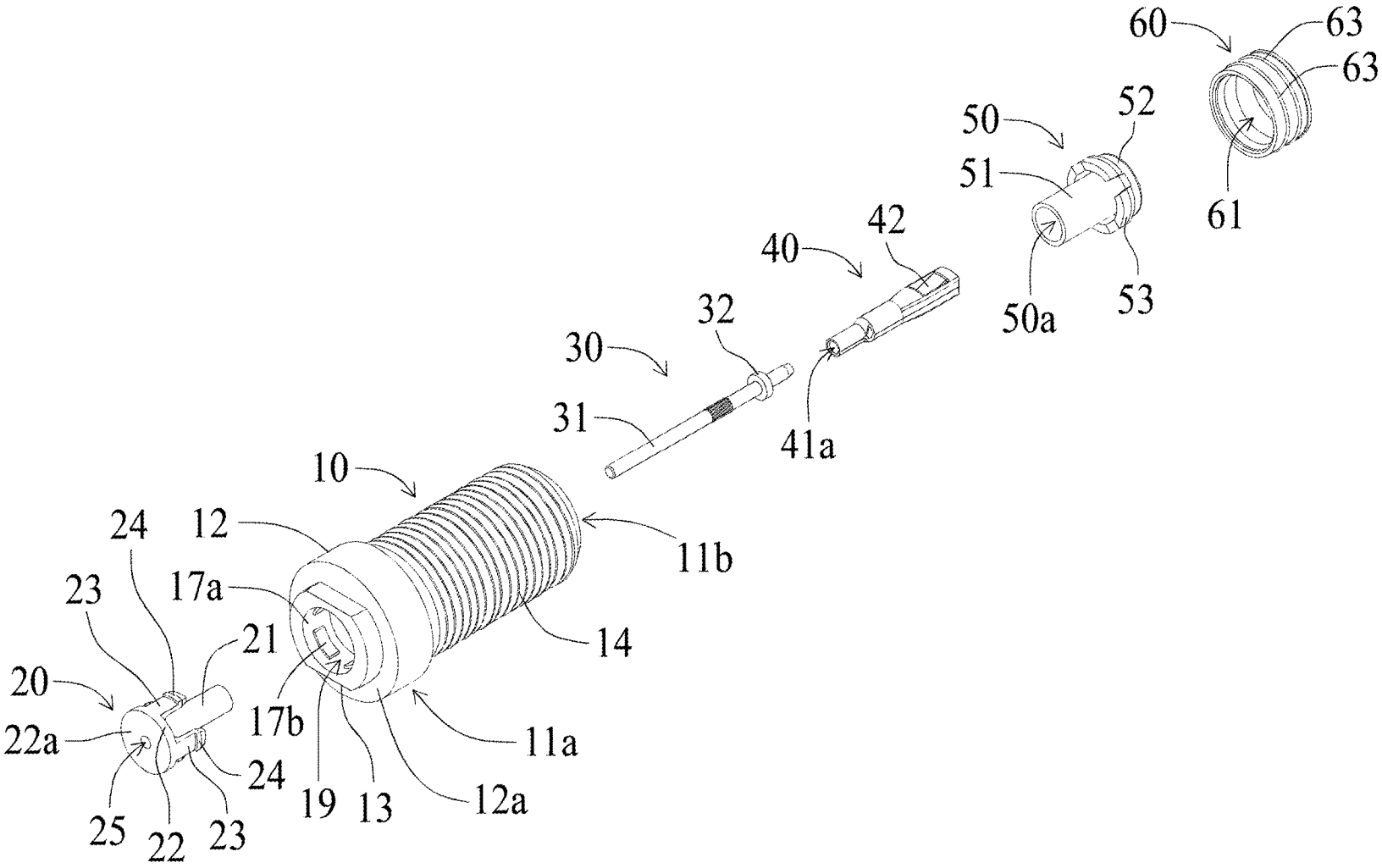
FIG. 2 is an exploded view illustrating a coaxial cable connector according to various embodiments.
Figure 3:
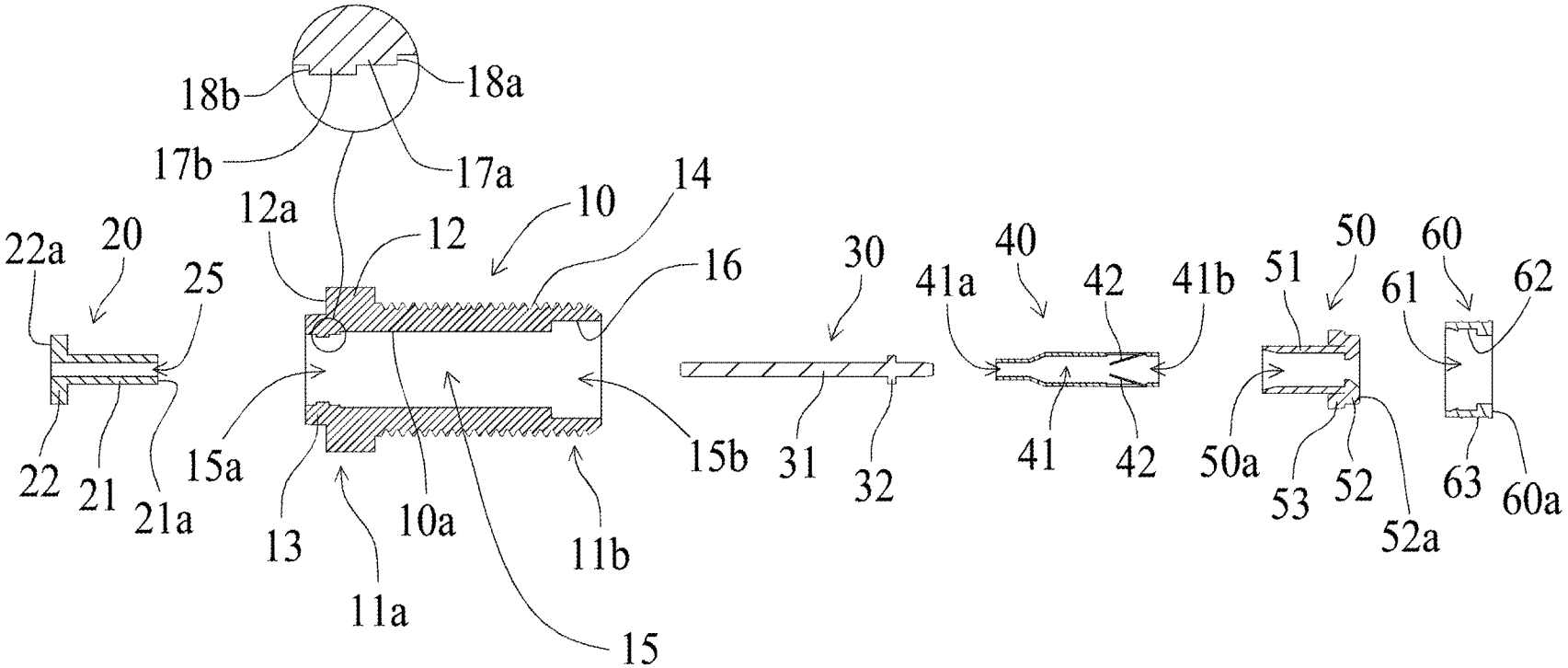
FIG. 3 is an exploded cross-sectional view illustrating a coaxial cable connector according to various embodiments.
Figure 4:
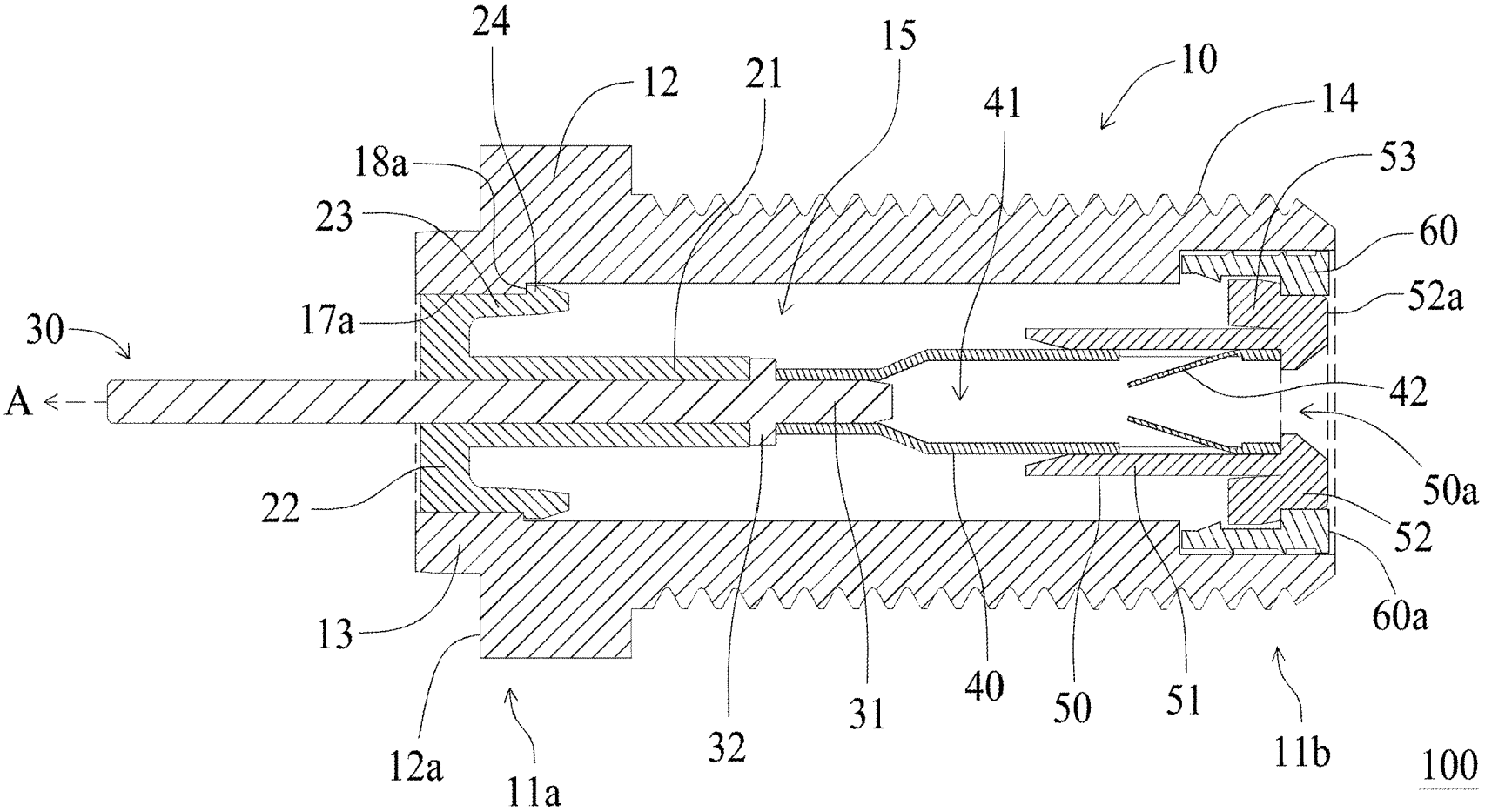
FIG. 4 is a cross-sectional view illustrating a coaxial cable connector according to various embodiments.

FIG. 2 is an exploded view illustrating a coaxial cable connector according to various embodiments. FIG. 3 is an exploded cross-sectional view illustrating a coaxial cable connector according to various embodiments. FIG. 4 is a cross-sectional view illustrating a coaxial cable connector according to various embodiments. As shown in FIGS. 2-4, with reference to FIG. 1, in an embodiment, the coaxial cable connector 100 comprises a connector body 10, a first dielectric component 20, a second dielectric component 50, a first conductor component 30, a second conductor component 40, and an inner sleeve 60. As an example, and not to be limiting, the first dielectric component 20 and connector body 10 can be first snap fit together, for assembly of the coaxial cable connector 100. Next, the first conductor component 30, second conductor component 40, second dielectric component 50, and the inner sleeve 60 can be sequentially assembled thereto thereafter. In the embodiments, the snap fit assembly of the first dielectric component 20 and connector body 10, allows for relatively quick and easy assembly of the coaxial cable connector 100, a fixing means via the first dielectric component 20 for the first conductor component 30 within the connector body 10, and an insulating means also via the first dielectric component 20 between the first conductor component 30 and connector body 10.

In an embodiment, the connector body 10 has a threaded outer surface 14, a radially protruding head portion 12, an altered hex-shaped end portion 13 and a through-hole 15 therethrough having a central axis. The through-hole 15 comprises a first body opening end 15*a* and a second body opening end 15*b* opposite the first body opening end 15*a*. The connector body 10 further comprises a first connector body end 11*a* and a second connector body end 11*b* surrounding the first body opening end 15*a* and a second body opening end 15*b*, respectively. In an embodiment, an inner diameter of the first body opening end 15*a* is less than an inner diameter of the second body opening end 15*b*; however, the embodiments are not limited thereto. In alternative embodiments, the inner diameter of the first body opening end 15*a* can be equal to or greater than the inner diameter of the second body opening end 15*b*. The altered hex-shaped end portion 13 and radially protruding head portion 12 surround the first body opening end 15*a* of the connector body 10. In an embodiment, the radially protruding head portion 12 is ring-shaped and has a front head portion side surface 12*a*; however the embodiments are not limited thereto. In alternative embodiments, the radially protruding head portion 12 can be other shapes. In an embodiment, the altered hex-shaped end portion 13 has two opposite flat sides for securing of the connector body 10; however, the embodiments are not limited thereto. Others shapes or designs can be used for connection of the coaxial cable connector 100 to an electromagnetic interference (EMI) shielded enclosure or housing. A front surface of the altered hex-shaped end portion 13 is flush with the first body opening end 15*a* of the connector body 10 and the front head portion side surface 12*a* of the radially protruding head portion 12 protrudes from the altered hex-shaped end portion 13 and is disposed adjacent thereto, between the altered hex-shaped end portion 13 and threaded outer surface 14. When the coaxial cable connector 100 is connected to an electromagnetic interference (EMI) shielded enclosure or housing of a cable TV decoder, digital video recorder and DVD recorder, satellite receiver and distribution amplifier or signal splitter, etc., having a connection means built therein, the altered hex-shaped end portion 13 is connected to the enclosure or housing and the front head portion side surface 12*a* of the radially protruding head portion 12 abuts the enclosure or housing. A twistable element can be connected to the coaxial cable connector 100 via the threaded outer surface 14 of the connector body 10. As an example, but not to be limiting, the twistable element can be a nut of a coaxial cable connector, wherein the coaxial cable connector is a twistable F-type coaxial cable connector. Accordingly, the first connector body end 11*a* of the connector body 10 can be mounted to the enclosure or housing and a coaxial cable connector can be mounted to the second connector body end 11*b*.

In an embodiment, the through-hole 15 has a radially inner protruding end portion 17*a* disposed on an inner surface of the first connector body end 10, wherein the radially inner protruding end portion 17*a* has an annular inner lock back wall 18*a* facing the second body opening end 15*b* and a plurality of guide protrusions 17*b* laterally disposed thereon. In alternative embodiments, the radially inner protruding end portion 17*a* is disposed on an inner surface other than the first connector body end 10. In an embodiment the radially inner protruding end portion is ring-shaped. The plurality of guide protrusions 17*b* each has an inner guide front wall 18*b* facing the first body opening end 15*a* and are separated by two opposite side walls perpendicular to the inner guide front wall 18*b*, forming a plurality of guide passageways 19 between each of the plurality of guide protrusions 17*b*. In an embodiment, the plurality of guide protrusions 17*b* comprises two (2) guide protrusions 17*b*; however, the embodiments are not limited thereto. In alternative embodiments, the plurality of guide protrusions 17*b* comprises more than two (2) guide protrusions 17*b*. In an embodiment the shape of the plurality of guide protrusions 17*b* is an arc-like shape; however the embodiments are not limited thereto. In alternative embodiments, other shapes can be employed for the plurality of guide protrusions 17*b*. In an embodiment, an angle from the central axis to two parallel points on each of the two opposite side walls perpendicular to the inner guide front wall 18*b* of the plurality of guide protrusions 17*b* is 30° to 120° degrees.

In an embodiment, the first dielectric component 20 has a cylindrical center tube 25, a radially protruding head end portion 22 surrounding a front end of the cylindrical center tube 25, and a plurality of flexible snap hooks 23, each having a snap hook end 24, flaring backwards from a backside of the radially protruding head end portion 22 along the outside of the cylindrical center tube 25 having a plurality of backside spaces therebetween. The plurality of flexible snap hooks 23 comprises at least two (2) flexible snap hooks; however, the embodiments are not limited thereto. In alternative embodiments, more than two (2) flexible snap hooks can be employed. In an embodiment, a length of the cylindrical center tube 25 is greater than a length of each of the plurality of flexible snap hooks 23. The plurality of flexible snap hooks 23, each having a snap hook end 24, slide along the plurality of guide passageways 19 of the radially inner protruding end portion 17*a* and between the plurality of guide protrusions 17*b*, fittably hooking and locking against the annular inner lock back wall 18*a* of the radially inner protruding end portion 17*a*. In an embodiment, an angle from the central axis to two parallel points on each of two opposite lateral side walls of each of the plurality of flexible snap hooks 23 is 15° to 90° degrees. The plurality of backside spaces of the first dielectric component 20 fittably rest upon each of the inner guide front walls 18*b* of the connector body 10. The central axis of the connector body 10 and first dielectric component 20 are the same. The first dielectric component 20 is engaged and fixed within the first body opening end 15*a* of the connector body 10, with a front head end portion side surface 22*a* slightly inward of the first body opening end 15*a* of the connector body 10.

As an example, and not to be limiting, the first dielectric component 20 and connector body 10 can be first snap fit together, for assembly of the coaxial cable connector 100. To begin, the first dielectric component 20 is disposed in the through-hole 15 via the first body opening end 15*a*. The plurality of flexible snap hooks 23, each having a snap hook end 24, slide along the plurality of guide passageways 19 of the radially inner protruding end portion 17*a* and between the plurality of guide protrusions 17*b*, fittably hooking and locking against the annular inner lock back wall 18*a* of the radially inner protruding end portion 17*a*. The plurality of backside spaces of the first dielectric component 20 fittably rest upon each of the inner guide front walls 18*b* of the connector body 10. Accordingly, once snap fit assembled, undesired movement of the first dielectric component 20 from the connector body 10 is hindered rotationally, by the plurality of flexible snap hooks 23 and plurality of guide protrusions 17*b*, respectively, and vertically, by the snap hook end 24, fittably hooking and locking against the annular inner lock back wall 18*a*, respectively, and the plurality of backside spaces of the first dielectric component 20 fittably resting upon each of the inner guide front walls 18*b*, respectively. Next, the first conductor component 30, second conductor component 40, second dielectric component 50, and the inner sleeve 60 can be sequentially assembled thereto thereafter.

In an embodiment, the first conductor component 30, comprises a center conductor 31 having a conductor front end and conductor back end, and an outer flange 32 surrounding the conductor back end, wherein the conductor front end extends through the cylindrical center tube 25, protruding to an outside of the radially protruding head end portion 22 surrounding the front end thereof and connector body 10. The outer flange 32 fittably rests upon on a back end of the cylindrical center tube 25. The first conductor component 30 can be made of a solid conductive material, and can be electrically connected to a coaxial cable having an electrical wire, sending electrical signals. In an embodiment, the first conductor component 30 can comprise a solid metal wire; however, the embodiments are not limited thereto. In alternative embodiments, other conductive materials can be employed.

In an embodiment, the coaxial cable connector 100 further comprises a second dielectric component 50 and a second conductor component 40. The second conductor component 40 has a second conductor through-hole 41 therethrough having a first conductor opening end 41*a* and a second conductor opening end 41*b* opposite thereto, wherein the first conductor opening end 41*a* is tapered and the second conductor opening end 41*b* is surrounded by a back section of the second conductor component 40. In an embodiment, a diameter of the first conductor opening end 41*a* is less than a diameter of the second conductor opening end 41*b*. The second conductor component 40 further comprises a plurality of flexible positioning guides 42 assembled to the back section thereof, each having a free front end and an attached back end. The plurality of flexible positioning guides 42 comprises at least two (2) plurality of flexible positioning guides 42; however the embodiments are not limited thereto. In alternative embodiments, more than two (2) flexible positioning guides 42 can be employed. In an embodiment, the shape of the plurality of flexible positioning guides 42 is the same. The free front ends extend downward and inward toward a center of a second conductor through-hole 41. The central axis of the second conductor component 40 and connector body 10 are the same. As an example, and not to be limiting, in the embodiments, the second conductor component 40 can be a metal pipe comprising copper, aluminum, silver, nickel, zinc, bismuth, or any combination thereof.

In an embodiment, when the coaxial cable connector 100 is connected to a coaxial cable connector an electrical wire (not shown) is assembled through the second conductor opening end 41*b*, within the second conductor through-hole 41 of the second conductor component 40. The electrical wire (not shown) contacts the plurality of flexible positioning guides 42 of the second conductor component 40 and is electrical connected thereto. The second conductor component 40 fittably surrounds the conductor back end of the first conductor component 30 to rest upon the outer flange 32 thereof. The second conductor component 40 is electrically connected to the first conductor component 30. Electrical signals from a coaxial cable having the electrical wire can be sent via the plurality of flexible positioning guides 42 of the second conductor component 40 and first conductor component 30.

In an embodiment, the second dielectric component 50 has a second dielectric tube body 51 having a second dielectric through-hole 50*a*. The second dielectric through-hole 50*a* has a second dielectric front opening and a second dielectric back opening. In an embodiment, the second dielectric component 50 further comprises a radially protruding back end portion 52 having a plurality of flexible latch releases 53 flaring forward from a front side of the radially protruding back end portion 52 along the outside of the second dielectric through-hole 50*a*, wherein the radially protruding back end portion 52 surrounds the second dielectric back opening and is disposed flush therewith. In an embodiment, the plurality of flexible latch releases 53 comprises two (2) flexible latch releases 53; however, the embodiments are not limited thereto. The plurality of flexible latch releases 53 can comprise more than two (2) flexible latch releases 53. In an embodiment, a length of the second dielectric tube body 51 is greater than a length of each of the plurality of flexible latch releases 53.

As an example, but not to be limiting, in an embodiment, the second dielectric tube body 51 and radially protruding back end portion 52, having the plurality of flexible latch releases 53 of the second dielectric component 50 are integrally formed.

In an embodiment, the tapered front end of the second conductor component 40 fittably surrounds the conductor back end of the first conductor component 30 to rest upon the outer flange 32 thereof, opposite the back end of the cylindrical center tube 25 of the first dielectric component 20. The second dielectric front opening fittably surrounds the back section of the second conductor component 40. The second dielectric component 50 and the second conductor component 40 are disposed in the through-hole 15 of the connector body 10. The first conductor component 30 is electrically connected to the second conductor component 40, sending electrical signals from a coaxial cable having an electrical wire connected thereto.

In an embodiment, the coaxial cable connector 100 further comprises an inner sleeve 60 fittably assembled within a radially indented inner end portion 16 of the second body opening end 15*b* of the connector body 10 and fittably surrounding the second dielectric back opening of the second dielectric component 50. In an embodiment, the inner sleeve 60 has an inner sleeve through-hole 61 therethrough. The inner sleeve through-hole 61 has a front inner sleeve opening end and a back inner sleeve opening end, having a radially indented inner middle portion 62 therebetween. In an embodiment the inner sleeve 60 further comprises a back inner sleeve end side surface 60*a* and a plurality of radial hooks 63 on the outer surface thereof. In an embodiment the plurality of radial hooks 63 comprise two (2) radial hooks 63; however, the embodiments are not limited thereto. In alternative embodiments, more than two (2) radial hooks 63 can be employed. The radial hooks 63 assist in gripping of the inner sleeve 60 to the radially indented inner end portion 16 of the second body opening end 15*b* of the connector body 10. In an embodiment, the plurality of flexible latch releases 53 flaring forward from a front side of the radially protruding back end portion 52 of the second dielectric component 50 snap fits into the radially indented inner middle portion 62 of the inner sleeve 60. The radially protruding back end portion 52 of the second dielectric component 50 and back inner sleeve end side surface 60*a* of the inner sleeve 60 are disposed flush, slightly inward of the second body opening end 15*b* of the connector body 10. The central axis of the inner sleeve 60 and the connector body 10 are the same.

As an example, but not to be limiting, in an embodiment, the cylindrical center tube 25, radially protruding head end portion 22 and plurality of flexible snap hooks 23, each having a snap hook end 24, of the first dielectric component 20 are integrally formed. As another example, but not to be limiting, in an embodiment, the altered hex-shaped end portion 13, radially protruding head portion 12, threaded outer surface 14, inner connector body surface portion 10*a*, radially inner protruding end portion 17*a* and plurality of guide protrusions 17*b* of the connector body 10 are integrally formed.

In the embodiments, from a back viewpoint, the second body opening end 15*b* of the connector body 10 of the coaxial cable connector 100 is exposed, along with the back inner sleeve end side surface 60*a* of the inner sleeve 60, the second dielectric back opening of the second dielectric through-hole 50*a* and the protruding back end side surface 52*a* of the radially protruding back end portion 52, and the second conductive opening end 41*b* of the second conductor through-hole 41.

Unless otherwise indicated, all numbers used herein to express quantities, dimensions, and so forth used should be understood as being modified in all instances by the term "about." The use of the singular includes the plural unless specifically stated otherwise, and use of the terms "and" and "or" means "and/or" unless otherwise indicated.

From the foregoing it will be appreciated that, although specific embodiments have been described herein for purposes of illustration, various modifications can be made without deviating from the spirit and scope of the disclosure. Furthermore, where an alternative is disclosed for a particular embodiment, this alternative can also apply to other embodiments even if not specifically stated.

What is claimed is:

1. A coaxial cable connector, comprising:

a connector body having a threaded outer surface and a through-hole therethrough having a central axis comprising a first body opening end and a second body opening end opposite the first body opening end, wherein the through-hole has a radially inner protruding end portion disposed on an inner surface of the first connector body end, and wherein the radially inner protruding end portion has an annular inner lock back wall facing the second body opening end and a plurality of guide protrusions laterally disposed thereon, wherein the plurality of guide protrusions each has an inner guide front wall facing the first body opening end;

a first dielectric component engaged and fixed within the first body opening end of the connector body, having a cylindrical center tube, a radially protruding head end portion surrounding a front end of the cylindrical center tube, and a plurality of flexible snap hooks flaring backwards from a backside of the radially protruding head end portion along the outside of the cylindrical center tube having a plurality of backside spaces therebetween, wherein the plurality of flexible snap hooks fittably sit along the radially inner protruding end portion of the through-hole, fittably hooking and locking against the annular inner lock back wall thereof and the plurality of backside spaces fittably rest upon each of the inner guide front walls of the plurality of guide protrusions, and wherein the central axis of the connector body and first dielectric component are the same; and a first conductor component extending through the cylindrical center tube.

2. The coaxial cable connector of claim 1, wherein the connector body further comprises an altered hex-shaped end portion, and wherein the altered hex-shaped end portion has two opposite flat sides for securing of the connector body.

3. The coaxial cable connector of claim 2, wherein the altered hex-shaped end portion is ring-shaped.

4. The coaxial cable connector of claim 1, wherein the connector body further comprises an altered hex-shaped end portion surrounding the first body opening end thereof, and wherein the altered hex-shaped end portion has two opposite flat sides for securing of the connector body.

5. The coaxial cable connector of claim 4, wherein the connector body further comprises a radially protruding head portion surrounding the first body opening end thereof.

6. The coaxial cable connector of claim 1, wherein the radially inner protruding end portion disposed on the inner surface end of the first body opening end having the annular inner lock back wall facing the second body opening is ring-shaped.

7. The coaxial cable connector of claim 6, wherein the plurality of guide protrusions comprises at least two guide protrusions, each having arc-like shapes.

8. The coaxial cable connector of claim 7, wherein each of the plurality of guide protrusions further comprises two opposite side walls perpendicular to the inner guide front wall, and wherein an angle from the central axis to two parallel points on each of the two opposite side walls is 30° to 120° degrees.

9. The coaxial cable connector of claim 1, wherein an inner diameter of the first body opening end is less than an inner diameter of the second body opening end.

10. The coaxial cable connector of claim 1, wherein a length of the cylindrical center tube is greater than a length of the plurality of flexible snap hooks.

11. The coaxial cable connector of claim 1, wherein the first conductor component can be electrically connected to a coaxial cable having an electrical wire, sending electrical signals.

12. The coaxial cable connector of claim 1, wherein the first conductor component, extending through the cylindrical center tube, comprises a center conductor having a conductor front end and conductor back end, and an outer flange surrounding the conductor back end, wherein the conductor front end extends through the cylindrical center tube, protruding to an outside of the radially protruding head end portion surrounding the front end thereof and connector body, and wherein the outer flange fittably rests upon on a back end of the cylindrical center tube.

13. The coaxial cable connector of claim 12, further comprising a second dielectric component and a second conductor component, wherein the second conductor component has a tapered front end and a back section, and wherein the second dielectric component has a second dielectric tube body having a second dielectric through-hole having a second dielectric front opening and a second dielectric back opening, wherein the tapered front end of the second conductor component fittably surrounds the conductor back end of the center conductor of the first conductor component to rest upon the outer flange thereof, opposite the back end of the cylindrical center tube of the first dielectric component, and wherein the second dielectric front opening fittably surrounds the back section of the second conductor component, and wherein the second dielectric component and the second conductor component are disposed in the through-hole of the connector body.

14. The coaxial cable connector of claim 13, wherein the first conductor component is electrically connected to the second conductor component, sending electrical signals from a coaxial cable having an electrical wire.

15. The coaxial cable connector of claim 13, wherein the second conductor component further comprises a plurality of flexible positioning guides assembled to the back section thereof, each having a free front end and an attached back end, wherein the free front end extends downward and inward toward a center of a second conductor through-hole, and wherein the central axis of the second conductor component and connector body are the same.

16. The coaxial cable connector of claim 13, further comprising an inner sleeve fittably assembled within the second body opening end of the connector body and fittably surrounding a second dielectric back opening of the second dielectric component.

17. The coaxial cable connector of claim 1, wherein the first conductor component comprises a solid metal wire.

18. The coaxial cable connector of claim 1, wherein the cylindrical center tube, radially protruding head end portion and plurality of flexible snap hooks of the first dielectric component are integrally formed.

19. The coaxial cable connector of claim 1, wherein the threaded outer surface, inner connector body surface portion, radially inner protruding end portion and plurality of guide protrusions of the connector body are integrally formed.

20. The coaxial cable connector of claim 1, wherein each of the plurality of flexible snap hooks further comprises two opposite lateral side walls, and wherein an angle from the central axis to two parallel points on each of the two opposite lateral side walls is 15° to 90° degrees.

* * * * *